US007661330B2

(12) United States Patent
Hasegawa et al.

(10) Patent No.: US 7,661,330 B2
(45) Date of Patent: Feb. 16, 2010

(54) STARTER FOR CRANKING INTERNAL COMBUSTION ENGINE

(75) Inventors: Youichi Hasegawa, Kasugai (JP); Kazuaki Murase, Kounan (JP); Sadayoshi Kajino, Nagoya (JP)

(73) Assignee: Denso Corporation, Kariya (JP)

( * ) Notice: Subject to any disclaimer, the term of this patent is extended or adjusted under 35 U.S.C. 154(b) by 662 days.

(21) Appl. No.: 11/227,122

(22) Filed: Sep. 16, 2005

(65) Prior Publication Data

US 2006/0144176 A1 Jul. 6, 2006

(30) Foreign Application Priority Data

Dec. 16, 2004 (JP) ..... 2004-364589

(51) Int. Cl.
*F02N 15/02* (2006.01)

(52) U.S. Cl. ..... 74/7 C; 74/6

(58) Field of Classification Search ..... 74/6, 74/7 R, 7 C, 7 E; 403/359.1–359.6; 464/16, 464/17

See application file for complete search history.

(56) References Cited

U.S. PATENT DOCUMENTS

| | | | | |
|---|---|---|---|---|
| 3,365,913 | A * | 1/1968 | Shields | 464/16 |
| 4,987,786 | A * | 1/1991 | Morishita et al. | 74/7 C |
| 5,076,109 | A * | 12/1991 | Isozumi | 74/7 A |
| 5,105,670 | A * | 4/1992 | Isozumi et al. | 74/6 |
| 5,129,271 | A * | 7/1992 | Isozumi et al. | 74/7 R |
| 5,154,089 | A * | 10/1992 | Konishi | 74/7 E |
| 5,154,090 | A * | 10/1992 | Konishi | 74/7 E |
| 7,040,988 | B2 * | 5/2006 | Kayamoto | 464/17 |
| 7,305,899 | B2 | 12/2007 | Kajino et al. | |
| 2003/0056610 | A1 * | 3/2003 | Yamada et al. | 74/7 A |
| 2005/0081659 | A1 | 4/2005 | Murase et al. | |

FOREIGN PATENT DOCUMENTS

| | | | |
|---|---|---|---|
| EP | 1457669 | A2 * | 9/2004 |
| JP | Y2-06-023742 | | 6/1994 |
| JP | A-10-238441 | | 9/1998 |
| JP | A-2004-270616 | | 9/2004 |
| JP | A-2005-120899 | | 5/2005 |
| JP | A-2005-240706 | | 9/2005 |

OTHER PUBLICATIONS

U.S. Appl. No. 11/066,134, filed Feb. 25, 2005, Kazuaki Murase et al.

* cited by examiner

*Primary Examiner*—Richard W L Ridley
*Assistant Examiner*—Phillip Johnson
(74) *Attorney, Agent, or Firm*—Oliff & Berridge, PLC

(57) ABSTRACT

A rotational torque of an electric motor of a starter is transmitted to an output shaft having a pinion gear engaging with a ring gear of an internal combustion engine via a one-way clutch. A tube forming a clutch-inner and the output shaft are spline-coupled to allow the output shaft to reciprocally move in the axial direction while transmitting the rotational torque of the tube to the output shaft. The output shaft is slidably supported by a supporting portion formed at a front end of the tube. To establish air communication between an inside space of the tube and an outside space, an air passage is formed either in the supporting portion or on the output shaft. Pressure changes in the inner space due to reciprocal movement of the output shaft are suppressed by air communication through the air passage, and lubricant in the tube is well retained therein.

8 Claims, 4 Drawing Sheets

STARTER FOR CRANKING INTERNAL COMBUSTION ENGINE

CROSS-REFERENCE TO RELATED APPLICATION

This application is based upon and claims benefit of priority of Japanese Patent Application No. 2004-364589 filed on Dec. 16, 2004, the content of which is incorporated herein by reference.

BACKGROUND OF THE INVENTION

1. Field of the Invention

The present invention relates to a starter for cranking an internal combustion engine, the starter having a one-way clutch spline-coupled to an output shaft.

2. Description of Related Art

An example of a starter having a one-way clutch spline-coupled to an output shaft is disclosed in JP-A-2005-120899. The one-way clutch is composed of a clutch-outer driven by an electric motor and a clutch-inner coupled to the clutch-outer via clutch rollers. The tube-shaped clutch inner has a female spline that is connected to a male spline formed on the output shaft. A rotational torque of the electric motor is transmitted to the output shaft via the one-way clutch.

In this starter, air in a space behind a rear end of the output shaft is compressed or expanded according to reciprocal movement of the output shaft in the axial direction. In other words, the air in the space is subjected to a pumping action of the reciprocating output shaft. Lubricant such as grease retained in a space between the clutch-inner and the output shaft moves out to the space behind the read end of the output shaft according to the pumping action of the output shaft. This results in shortage of the lubricant between the output shaft and the clutch-inner.

In addition, it is possible that the lubricant entered the space behind the output shaft flows out into a further rear side space. The space behind the output shaft may be closed to prevent the lubricant flow. However, it cannot be avoided that the air in the space behind the output shaft is subjected to a pumping action of the reciprocating output shaft. According to the pumping action, pressure in the space changes and lubricant may be scattered around.

SUMMARY OF THE INVENTION

The present invention has been made in view of the above-mentioned problem, and an object of the present invention is to provide an improved starter, in which lubricant for lubricating an output shaft is well retained in the clutch-inner.

The starter includes an electric motor housed in a housing, and a rotational torque of the electric motor is transmitted to an output shaft via a one-way clutch. A pinion gear for engaging with a ring gear of an internal combustion engine is coupled to the front end of the output shaft. The one-way clutch is composed of a clutch-outer connected to the electric motor via a planetary gear device for reducing rotational speed, a tube constituting a clutch-inner, and rollers disposed between the clutch-outer and the clutch-inner. The tube includes a female spline coupled to a male spline formed on the output shaft. The output shaft is slidably supported by a supporting portion formed at a front portion of the tube. The output shaft is reciprocally driven in its axial direction by an electromagnetic switch mounted on the housing of the starter.

In order to establish communication between an inside space (a space between the tube and the output shaft including a space behind an axial end of the output shaft) and an outside space, an air passage is formed either on the output shaft or in the tube. The air passage may be formed through the supporting portion as a plurality of grooves that continue to the female spline formed in the tube. The grooves forming the air passage are easily made at the same time when the female spline of the tube is made. Alternatively, the air passage may be made on the output shaft as plural grooves continuing to depressed portions of the male spline of the output shaft.

The male spline and the female spline may be made as helical splines. The number of grooves forming the air passage in the supporting portion is made less than a half of the number of depressed portions of the female spline of the tube, so that the frontward movement of the output shaft is restricted by a stopper surface formed on the rear end of the supporting portion. The air passage is formed in the supporting portion or on the output shaft so that the communication between the inside space and the outside space is always established irrespective of positions of the output shaft in the axial direction. The space behind the rear end of the output shaft may be closed to a space further behind the one-way clutch, so that lubricant does not move out of the tube.

Pressure changes in the inside space due to a pumping action of the output shaft are alleviated by establishing communication between the inside space and the outside space through the air passage. Therefore, lubricant contained in the tube for lubricating the output shaft and the tube is well retained therein irrespective of the reciprocal movement of the output shaft. In addition, the reciprocal movement of the output shaft is not hindered by pumping action of the air in the inside space. Further, if small foreign particles enter in the inside space, they will be exhausted through the air passage.

Other objects and features of the present invention will become more readily apparent from a better understanding of the preferred embodiment described below with reference to the following drawings.

DETAILED DESCRIPTION OF THE PREFERRED EMBODIMENT

Figure 1:
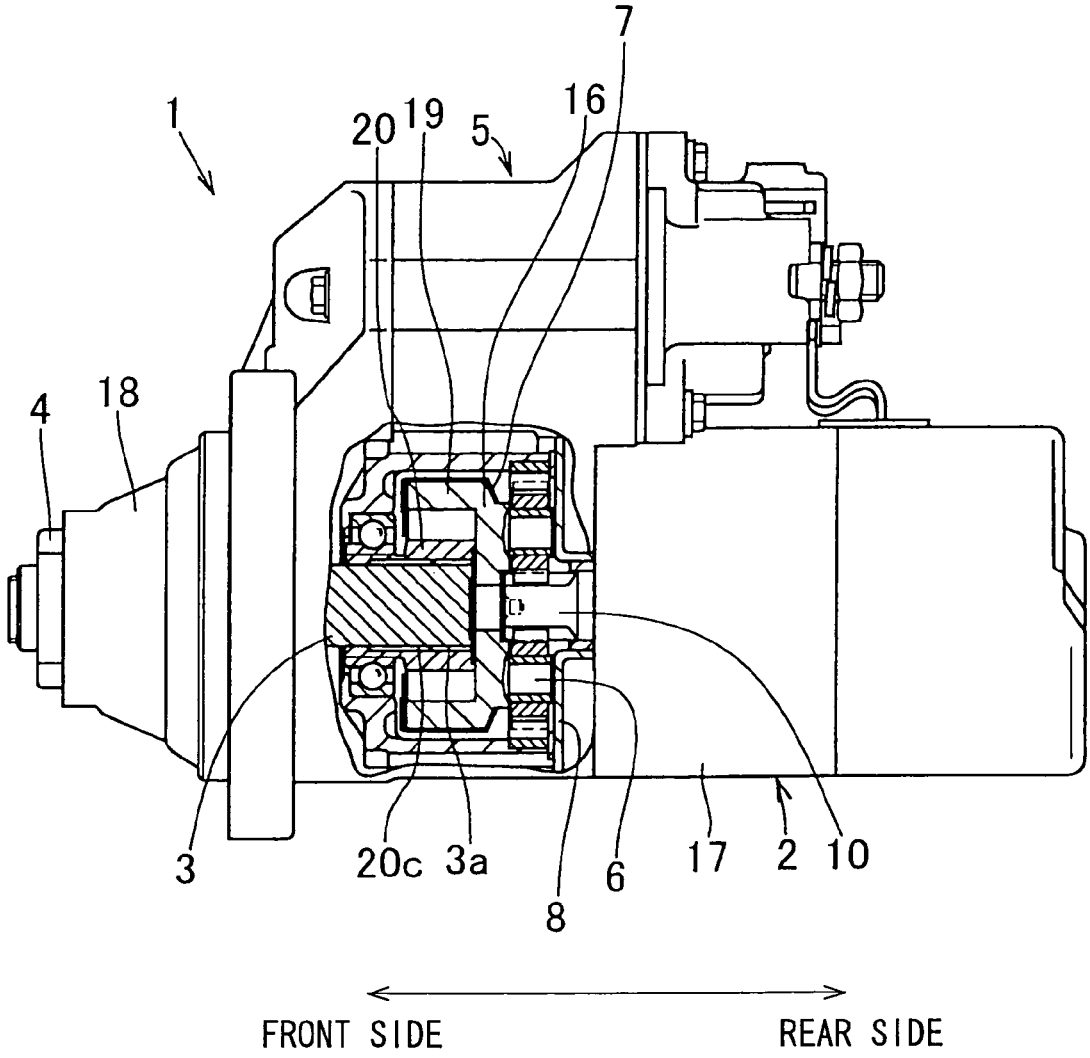
FIG. 1 is a side view showing a starter according to the present invention, partially showing an inside structure by a cross-sectional view.

A preferred embodiment of the present invention will be described with reference to accompanying drawings. A starter 1 shown in FIG. 1 is used for cranking an internal combustion engine. The starter 1 includes a housing (a front housing 18 and a rear housing 17), an electric motor 2 housed in the housing, an output shaft 3 having a pinion gear 4 connected to its front side, an electromagnetic switch 5, and a torque transmission mechanism composed of a planetary gear device 6 and a one-way clutch 7. A front side and a rear side of the starter 1 are shown in FIG. 1 and other drawings with an arrow.

A rotational torque of the electric motor 2 is transmitted to the planetary gear device 6 that reduces a rotational speed and then to the one-way clutch 7 that transmits the rotational torque only from the electric motor 2 to the output shaft 3. A space containing the electric motor 2 is separated from an inner space of the torque transmission mechanism by a separating wall 8. A thrust washer 9 (shown in FIG. 2) is disposed in contact with a front surface of the separating wall 8. The electric motor 2 includes a motor shaft 10 rotatably supported in the housing.

Figure 2:
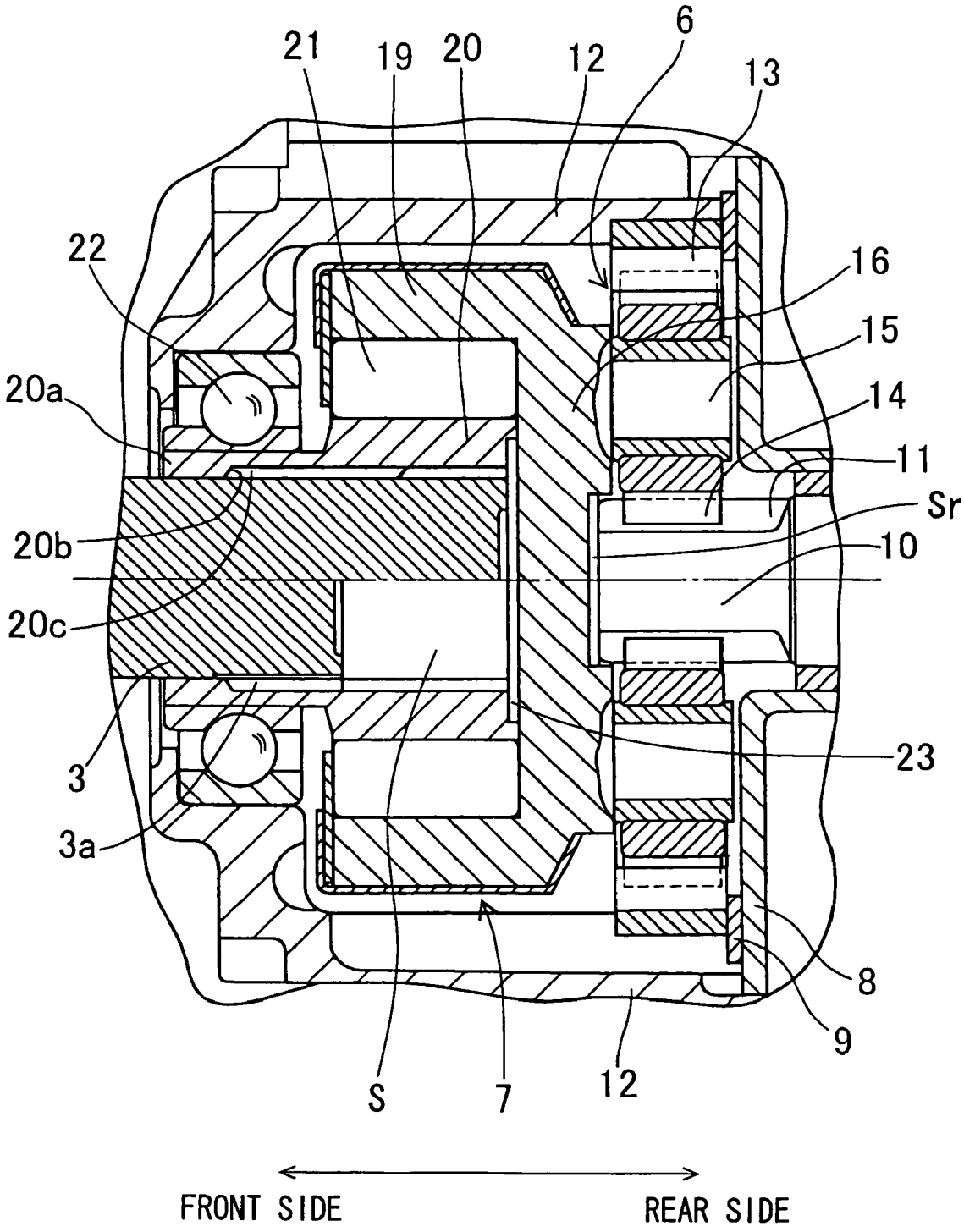
FIG. 2 is a cross-sectional view showing a one-way clutch and a planetary gear device in the starter, in an enlarged scale.

Referring to FIG. 2, the planetary gear device 6 will be briefly described. The planetary gear device 6 is a known device including a sun gear 11 formed at a front end of the motor shaft 10, a ring-shaped internal gear 13 fixed to a center case 12, planetary gears 14 engaging with the sun gear 11 and the internal gear 13, and a carrier 16 having gear shafts 15 rotatably supporting the planetary gears 14. The planetary gears 14 orbit around the sun gear 11 while being rotated. A rotational speed of the motor shaft 10 is reduced to an orbital speed of the planetary gears 14, and the carrier 16 constituting a part of the one-way clutch 7 rotates at the orbital speed. The center case 12 connected to the housing contains the planetary gear device 6 and the one-way clutch 7 therein. A rear end of the center case 12 is closed by the separating wall 8 and the thrust washer 9. The front end of the motor shaft 10 having the sun gear 11 extends through a center hole of the separating wall 8, and the motor shaft 10 is rotatably supported by the separating wall 8 via a bearing.

The one-way clutch 7 will be briefly described with reference to FIG. 2. The one-way clutch 7 is composed of a clutch-outer 19 integrally formed with the carrier 16, a tube 20 serving as a clutch-inner and clutch rollers 21 disposed between the clutch outer 19 and the tube 20. A rotational torque of the clutch-outer 19 is transmitted to the tube 20 via the clutch rollers 21. A female helical spline 20*c* engaging with a male helical spline 3*a* formed on the output shaft 3 is formed in an inner bore of the tube 20. The tube 20 has a supporting portion 20*a*, which slidably supports the output shaft 3, formed at its front end. The tube 20 is rotatably supported in the center case 12 via a ball bearing 22. A rotational torque of the tube 20 (serving as the clutch-inner of the one-way clutch 7) is transmitted to the output shaft 3.

The output shaft 3 having the male helical spline 3*a* formed at a rear portion of the output shaft 3 reciprocally moves in the axial direction in the tube 20. An upper half of the output shaft 3 shown in FIG. 2 shows a rear-most position and the lower half shows a front-most position. At a rear end of the supporting portion 20*a*, a stopper surface 20*b* is formed so that a forward movement of the output shaft 3 is restricted by abutment of the male helical spline 3*a* with the stopper surface 20*b*. When the output shaft 3 takes the rear-most position, the rear end of the output shaft 3 abuts a thrust washer 23 disposed in contact with the carrier 16. A front end portion of the output shaft 3 is slidably and rotatably supported by a bearing (not shown) fixed to the front housing 18.

The pinion gear 4 is spline-coupled to the front end of the output shaft 3 so that the pinion gear 4 is rotated by the output shaft 3. The electromagnetic switch 5 includes an excitation coil, to which electric current is supplied upon closure of a starting switch, a plunger driven by a magnetic field generated in the excitation coil, and a return spring for biasing the plunger to an initial position. A main switch for supplying power to the electric motor 2 is closed or opened according to the movement of the plunger, and at the same time, the output shaft 3 is moved in the axial direction by a shift lever connected to the plunger.

The starter 1 operates in the following manner. Upon closing the starting switch, the plunger is driven by the magnetic force generated in the excitation coil. The shift lever connected to the plunger drives the output shaft 3 forward. The pinion gear 4 engages with a ring gear of the engine, and the main switch is closed to supply power to the electric motor 2. The electric motor 2 generates a rotational torque that is transmitted to the output shaft 3 through the planetary gear device 6 and the one-way clutch 7. Thus, the engine is cranked up.

When the engine is cranked up, the starting switch is opened to stop power supply to the excitation coil. The plunger is returned to its original position by a biasing force of the return spring. In response to the movement of the plunger, the main switch is opened to terminate power supply to the electric motor 2. At the same time, the output shaft 3 is returned to its original position (to the rear-most position) by the shift lever connected to the plunger. At the rear-most position, the rear end of the output shaft 3 abuts the thrust washer 23.

Figure 3:
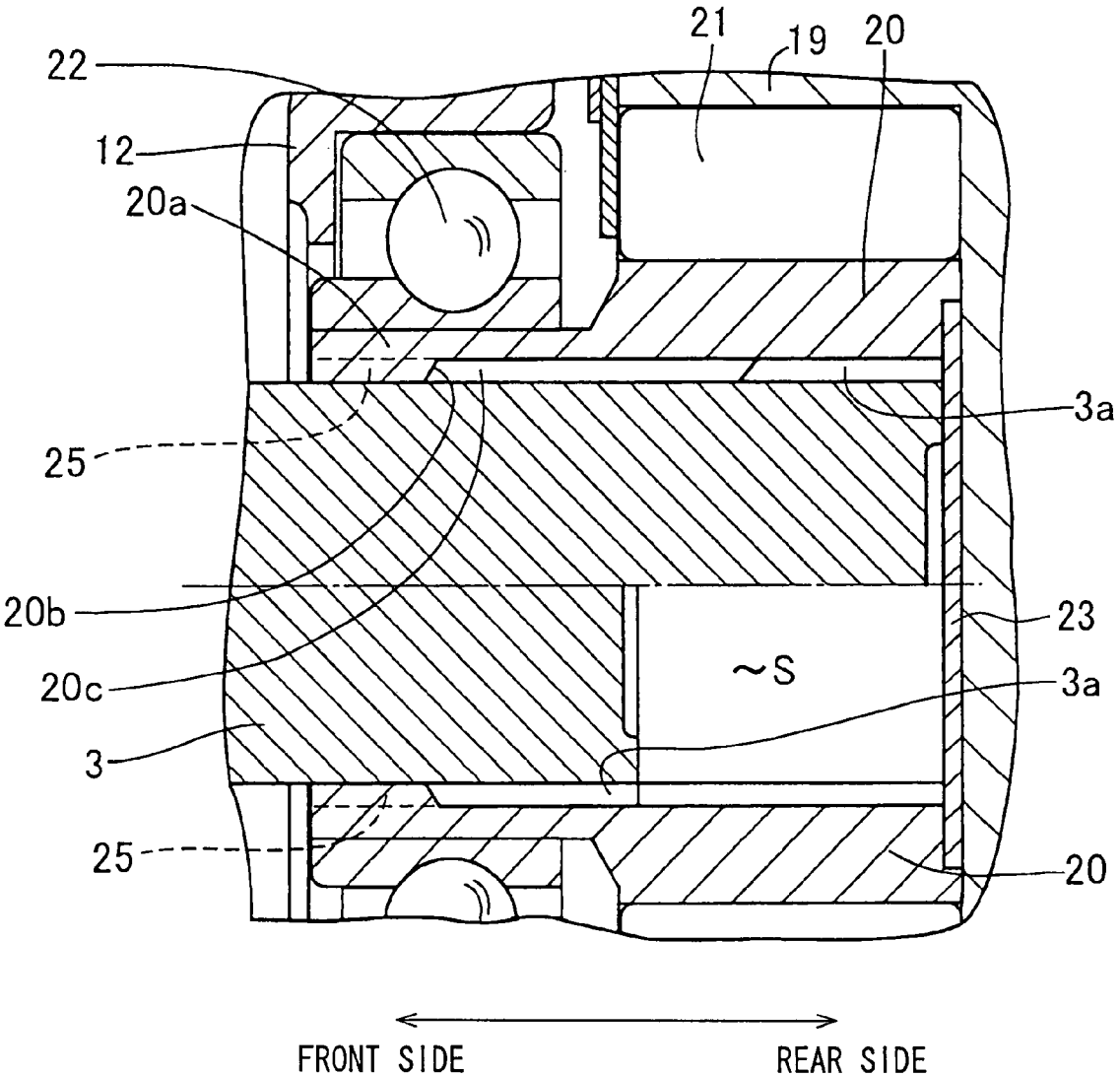
FIG. 3 is a cross-sectional view showing an air passage formed in a clutch-inner of the one-way clutch, in a further enlarged scale.

Now, referring to FIG. 3, an air passage 25 formed through the supporting portion 20*a* of the tube 20 will be described. The air passage 25 is constituted by plural grooves extending in the axial direction through the supporting portion 20*a*. The grooves are formed in the same direction as the female helical spline 20*c* with the same lead angle. However, the number of the grooves is made less than a half of the number of stripes of the helical spline 20*c*. Each groove of the air passage 25 continues to each groove of the female helical spline 20*c*.

A space (referred to as an inside space) between the inner bore of the tube 20 and the outer periphery of the output shaft 3 including a space S between the rear end of the output shaft 3 and the thrust washer 23 communicates with a space outside the tube 20 through the air passage 25. Thus, the pressure changes in the inside space including space S caused by the pumping action of the output shaft 3 are alleviated. The forward movement of the output shaft 3 beyond the front-most position is restricted by the stopper surface 20*b* formed at the rear end of the supporting portion 20*a*.

Figure 4:
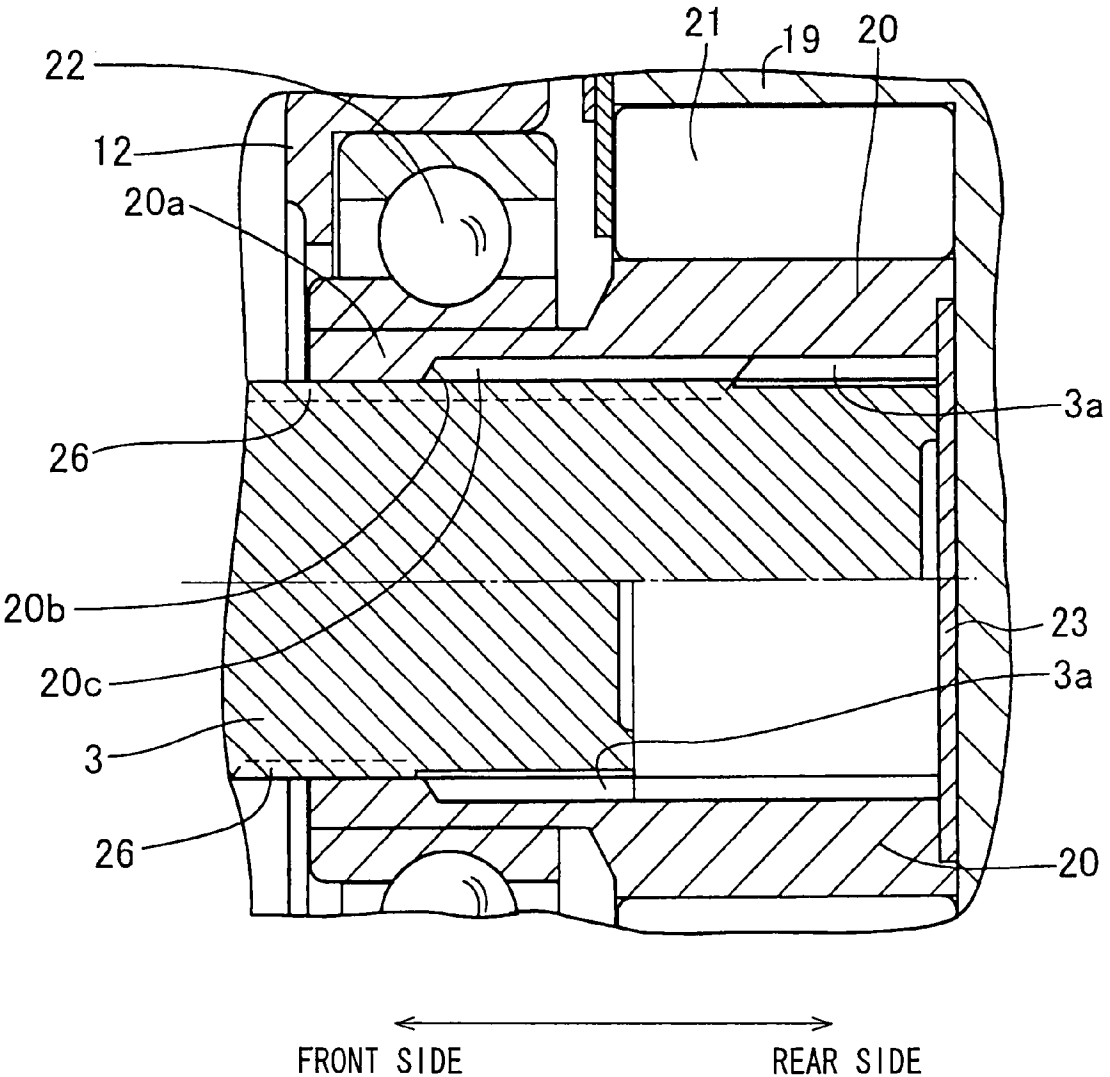
FIG. 4 is a cross-sectional view showing a modified form of the air passage shown in FIG. 3.

In reference to FIG. 4, a modified form of the air passage 25 will be described. An air passage 26 constituted by plural grooves is formed on the outer periphery of output shaft 3. Each groove extends from the front end of the male helical spline 3*a* to a predetermined position. That is, the front end position of the air passage 26 is determined so that it is positioned in front of the front end of the supporting portion 20*a* when the output shaft 3 takes the rear-most position, as shown in FIG. 4 (the upper half of the output shaft 3). In this manner, the inside space always communicates with the outside space through the air passage 26. Each groove forming the air passage 26 extends in the same direction as a groove portion of the male helical spline 3*a* with the same lead angle and continues to the groove portion of the male helical spline 3*a*. The forward movement of the output shaft 3 is restricted by the stopper surface 20*b* in this modified form, too.

In place of the grooves forming the air passage 26, a second male helical spline connected to the male helical spline 3*a* may be formed on the output shaft 3. In this case, however, an outer diameter of the second male helical spline has to be smaller than the outer diameter of the male helical spline 3*a* so that the second male helical spline does not engage with the female helical spline 20*c* formed inside the tube 20. The communication between the inside space and the outside space can be established in this manner, too.

The following advantages are attained in the present invention. The pressure variations or changes in the inside space due to the pumping action of the output shaft 3 are alleviated by establishing communication between the inside space and the outside space. Therefore, undesirable movement of the lubricant such as grease due to the pumping action can be alleviated. In addition, a braking effect of the pumping action on the axial movement of the output shaft 3 is alleviated. Further, small foreign particles entered into a sliding gap between the supporting portion 20*a* and the outer periphery of the output shaft 3 can be exhausted through the air passage 25, 26. Since the space S behind the rear end of the output shaft 3 is closed and pressure changes in the space S are suppressed, lubricant is prevented from flowing out to further rear side of the space S, e.g., to a space Sr (refer to FIG. 2) formed at a rear side of the one-way clutch.

The present invention is not limited to the embodiment described above, but it may be variously modified. For example, the helical spline 3*a*, 20*c* may be replaced with a straight spline. The air passage 25, 26 maybe formed independently from the helical spline 3*a*, 20*c*. While the present invention has been shown and described with reference to the foregoing preferred embodiment, it will be apparent to those skilled in the art that changes in form and detail may be made therein without departing from the scope of the invention as defined in the appended claims.

What is claimed is:

1. A starter for cranking an internal combustion engine, comprising:

a housing;

an electric motor housed in the housing;

an output shaft having a pinion gear connected to a front end of the output shaft for cranking the internal combustion engine, the output shaft having a male spline formed at its rear portion;

a one-way clutch transmitting a rotational torque of the electric motor to the output shaft, the one-way clutch including a tube serving as a clutch-inner of the one-way clutch, the tube having a female spline coupled to the male spline of the output shaft so that the output shaft moves back and forth in the tube in its axial direction, wherein:

the tube includes a supporting portion slidably contacting the output shaft, the supporting portion being formed at a front end of the tube, the supporting portion of the tube including a stopper surface for restricting a frontward movement of the output shaft; and an air passage for establishing communication between a space formed at a rear side of the supporting portion and a space outside the tube, the air passage is formed either in the tube or in the output shaft.

2. The starter for cranking an internal combustion engine as in claim 1, wherein:

a space formed in the tube behind a rear end of the output shaft is interrupted from a space at a rear side of the one-way clutch.

3. The starter for cranking an internal combustion engine as in claim 1, wherein:

the communication through the air passage is always established regardless of positions of the output shaft in its axial direction.

4. The starter for cranking an internal combustion engine as in claim 1, wherein:

the air passage is formed in a groove shape that inclines in the same circumferential direction as the spline.

5. The starter for cranking an internal combustion engine as in claim 4, wherein:

the air passage inclines by the same angle as the spline with respect to an axial direction of the tube.

6. The starter for cranking an internal combustion engine as in claim 1, wherein:

the air passage is formed on an outer periphery of the output shaft and is connected to the male spline formed on the output shaft.

7. The starter for cranking an internal combustion engine as in claim 1, wherein:

the air passage is formed through the supporting portion of the tube and is connected to the female spline of the tube.

8. The starter for cranking an internal combustion engine as in claim 1, wherein:

both of the male spline of the output shaft and the female spline of the tube are helical splines.

* * * * *